US005645321A

United States Patent [19]

Seroldi

[11] Patent Number: 5,645,321

[45] Date of Patent: Jul. 8, 1997

[54] PLANE FOR THE SEAT OF ARMCHAIRS, DIVANS, CHAIRS OR SIMILAR, WITH DEVICES FOR THE FIXING OF THE BELTS THAT TAKE ADVANTAGE OF THE TENSION OF THEMSELVES IN ORDER TO CONSTRAIN THEM TO THE SUPPORT FRAMEWORK

[76] Inventor: Giuseppe Seroldi, Via Baracca, 18 20038, Seregno (Milan), Italy

[21] Appl. No.: 618,940

[22] Filed: Mar. 20, 1996

[30] Foreign Application Priority Data

Apr. 21, 1995 [IT] Italy ..... MI9500282 U

[51] Int. Cl.[6] ..... A47C 7/32

[52] U.S. Cl. ..... 297/452.63; 297/452.18; 297/228.13; 297/218.5; 5/191; 5/200.1; 5/403

[58] Field of Search ..... 297/452.63, 452.18, 297/228.13, 218.5; 5/191, 236.1, 403, 200.1, 203, 305, 186.1

[56] References Cited

U.S. PATENT DOCUMENTS

| | | | |
|---|---|---|---|
| 50,713 | 10/1865 | Ingersoll | 5/191 |
| 179,007 | 6/1876 | Evans | 5/191 X |
| 248,065 | 10/1881 | Stewart | 5/191 X |
| 732,112 | 6/1903 | Ranz | 5/200.1 X |
| 978,954 | 12/1910 | Clair | 5/200.1 |
| 1,288,931 | 12/1918 | Lavezzi | 5/191 |
| 1,369,325 | 2/1921 | Coopersmith | 5/191 |
| 1,641,991 | 9/1927 | Ramsey | 5/191 X |
| 1,977,370 | 10/1934 | Allen | 5/191 |
| 3,088,517 | 5/1963 | Schwartz et al. | 297/452.63 X |
| 3,281,185 | 10/1966 | Albinson et al. | 292/218.5 X |
| 3,842,456 | 10/1974 | Bronstien, Jr. | 297/218.5 X |
| 4,858,992 | 8/1989 | LaSota | 297/452.63 X |
| 5,503,454 | 4/1996 | Sakamoto | 297/218.5 X |

FOREIGN PATENT DOCUMENTS

| | | | |
|---|---|---|---|
| 67663 | 6/1915 | Germany | 5/191 |
| 2340831 | 3/1974 | Germany | 297/218.5 |
| 820467 | 9/1959 | United Kingdom | 5/403 |
| 2035078 | 6/1980 | United Kingdom | 5/200.1 |

*Primary Examiner*—Peter M. Cuomo
*Assistant Examiner*—Rodney B. White
*Attorney, Agent, or Firm*—Notaro & Michalos P.C.

[57] ABSTRACT

A plane for the seat of armchairs, divans, chairs and similar furniture having a framework for the support of a plurality of belts forming the plane of the seat. The framework includes two lateral sections that each have a protruding tongue, provided with fixing U shaped elements oriented surrounding the tongue. Each belt passes outside the U shaped sections and is then folded up backwards and inserted between the tongue and the U shaped element so that the tension exerted by the belt presses the U shaped element in order to block the end of the belt against the tongue.

4 Claims, 3 Drawing Sheets

PLANE FOR THE SEAT OF ARMCHAIRS, DIVANS, CHAIRS OR SIMILAR, WITH DEVICES FOR THE FIXING OF THE BELTS THAT TAKE ADVANTAGE OF THE TENSION OF THEMSELVES IN ORDER TO CONSTRAIN THEM TO THE SUPPORT FRAMEWORK

This innovation proposes a plane for the seat of armchairs, divans, chairs or similar, of the type that includes a framework for the support of a plurality of belts that form the plane of the seat, in which means are provided that take advantage of the tension of the belts themselves in order to constrain them to said support framework.

More precisely, the framework to which the belts are fixed includes two sections that show a protruding tongue and are provided with fixing elements with a U shape, inserted around the edge of the tongues, with the belts that pass outside the U shaped sections, are folded backwards between the sections and the protruding tongues of the framework, so that the tension exerted by the belts presses the U shaped elements in order to block the end of the belts themselves against the tongues.

With this system the number of pieces that form the plane for the seat are considerably reduced and the plane results also simplified from the point of view of the assembly.

As it is known, the planes of seats used for armchairs, divans, chairs or the like are often formed by a plurality of belts provided at their ends with hooks that allow their application to a framework, generally formed by a couple of tubular elements fixed to support elements, which are also formed by tubular elements appropriately shaped.

This system is almost laborious as it is necessary to provide each belt with a couple of hooks, provided with a eyelet where it is possible to insert the end of the belt. It is then necessary to sew it or to fix the end of the belt to this eyelet and to provide, in the tubular elements of the framework, the holes necessary for the insertion of the hooks.

It is, as it can easily be understood, a very laborious system that should be appropriately simplified.

Now this innovation penetrates this environment and proposes a plane for the seat of armchairs, divans, chairs or the like, of the type that include a framework for the support of the plurality of belts that form the plane of the seat, where the framework includes a couple of sections that show a protruding tongue, around which a fixing element with a U shape is inserted, with the end of the belt included between the tongue and the shaped element and the belt that is folded up around the U shaped element and then stretched so that the tension itself of the belt keeps this U shaped element pressed against the tongue in order to block in position the end of the belt itself.

In this way a plane for a seat is obtained, which is formed by a lesser number of pieces and the result being that the seat is much simpler and faster to build and assemble.

This and other advantages will appear clearer in the detailed description that follows, provided as a non limitative example, with reference to the enclosed figures, where:

Figure 5:
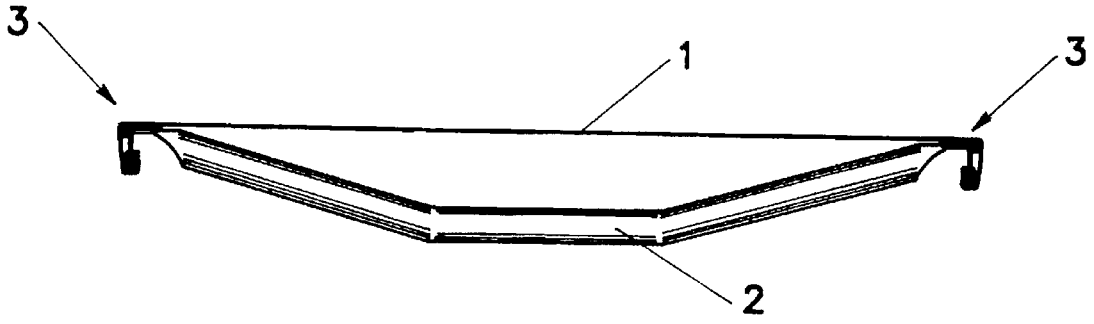
FIG. 5 is the front view according to the innovation.

With reference to FIG. 5, the plane is formed by a plurality of belts shown with number 1, fixed to a framework that includes a couple of base supports 2, formed for instance by tubular elements, with the ends flattened and folded upward, and by a couple of rods or lateral supports shown as a whole with number 3, to which the ends of the belts 1 are fixed.

These details can be better seen in FIGS. 1 to 4.

In particular, the rods 3 are formed by special sections with a shape that shows a bend 8, where the ends of the base supports 2 are inserted, and a wall or protruding tongue 5, which, in this specific case, protrudes downward.

The ends of the belts 1 are fixed to these rods.

Figure 4:
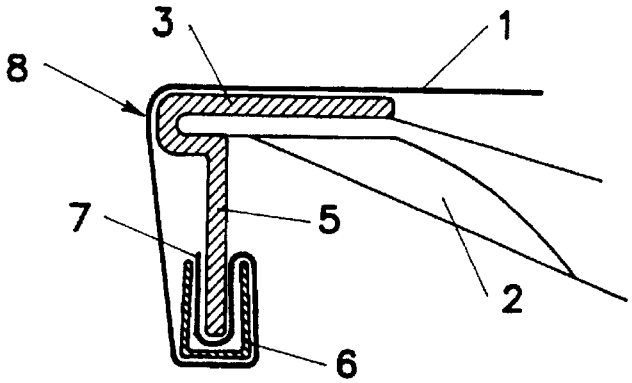
FIG. 4 shows, in vertical section, a detail of the plane according to the invention.
Figure 3:
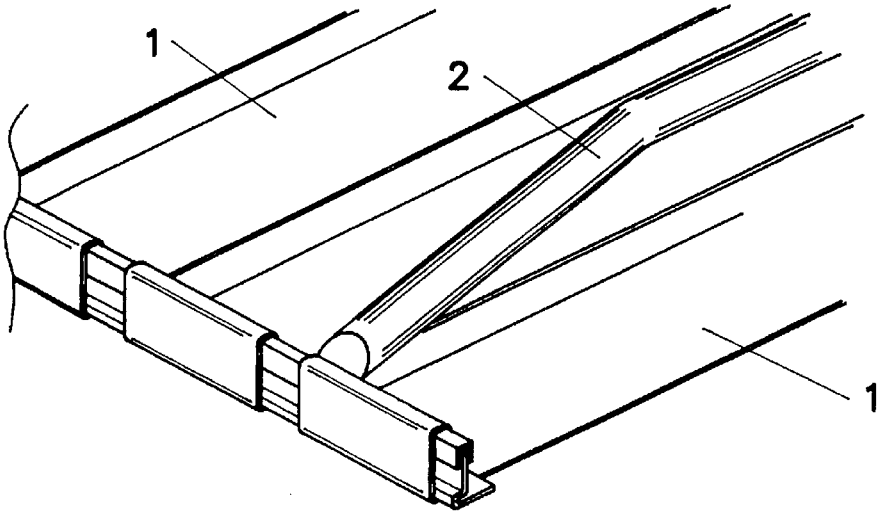
FIG. 3 is a perspective bottom view of the plane according to the innovation.

For this purpose, a blocking element is used, shown with number 6, formed by a section with a U shape, that is inserted around the tongue 5 in order to block in position the end of the belt 1, and this end is shown in. FIG. 4 with number 7.

The distance between the arms of the U shaped element 6 is substantially equal to the thickness of the tongue 5 plus two times the thickness of belt 1.

Preferably, anyway, the arms of the U shaped element 6 are slightly bent one towards the other, so that a certain elastic strength is exerted, that tends to block the end of the belt when this is folded up around the tongue 5, during the assembly of the plane of the seat.

The belt is then folded up backwards, passed over the U shaped element 6 and then around the rod 3 and at the end stretched, as it is shown in more detail in the following description.

Figure 1:
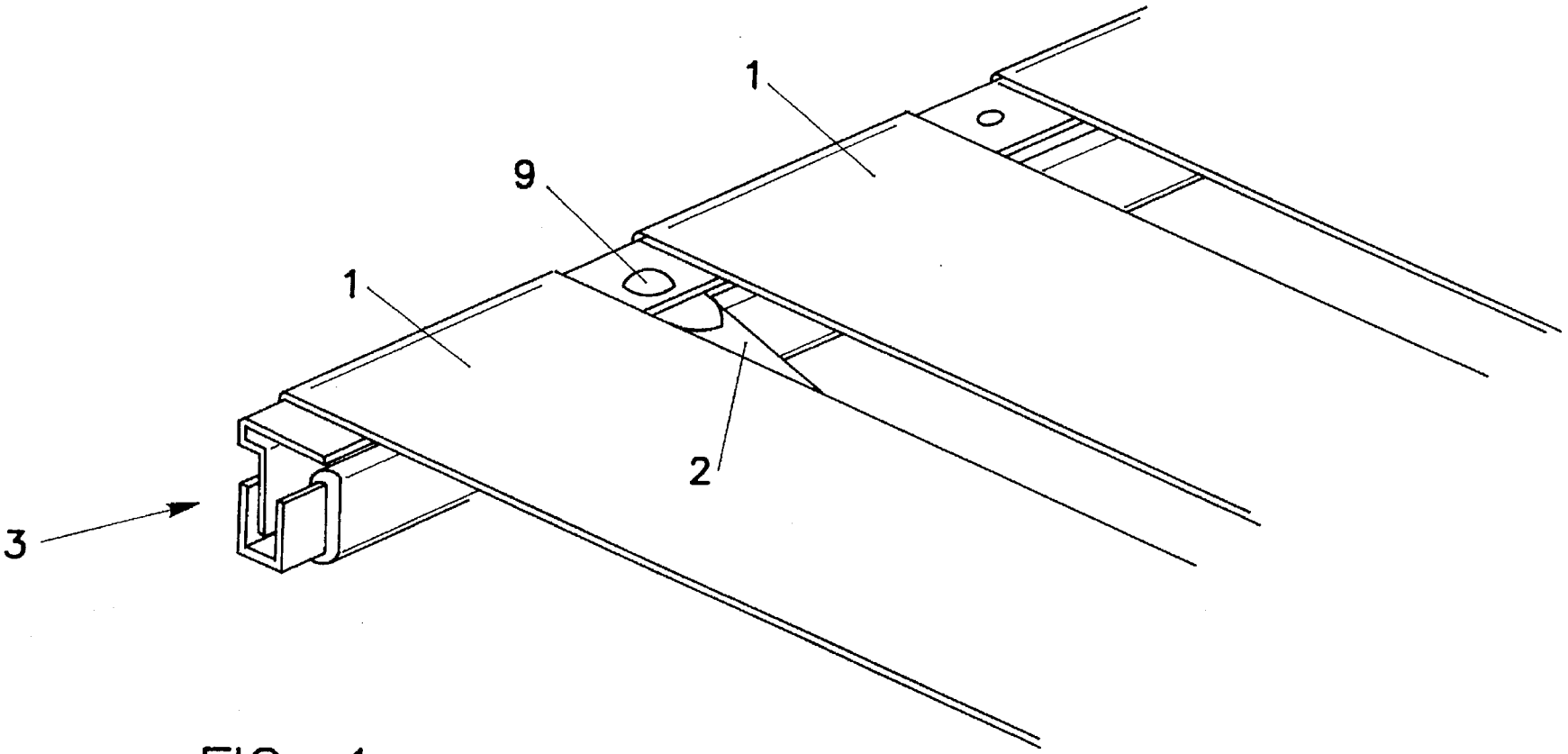
FIG. 1 is the partial perspective view of the plane for the seat according to the innovation.
Figure 2:
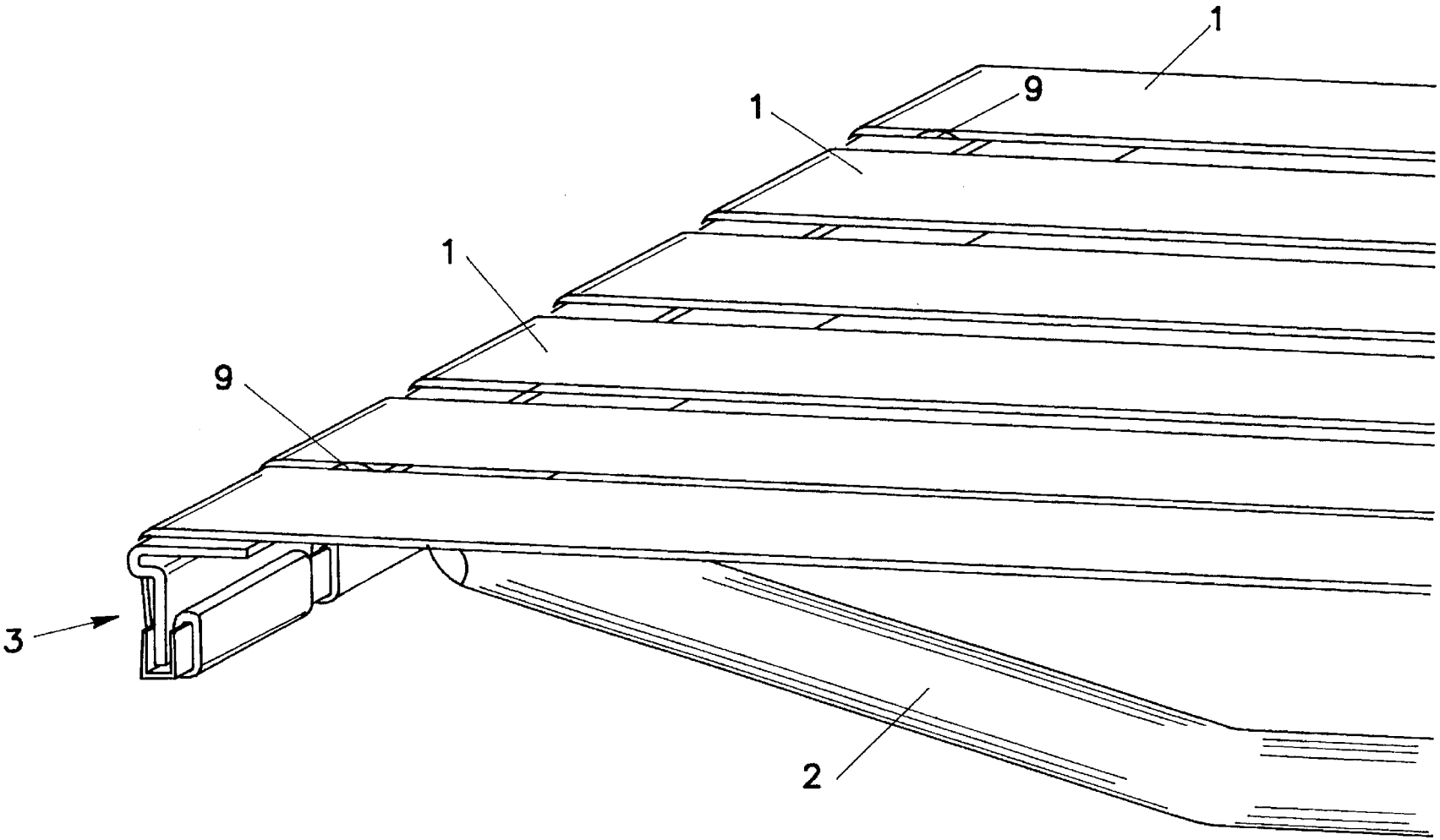
FIG. 2 is a further partial perspective view of the plane of the seat according to the innovation.

Besides, section 3 has a shape that shows a bend 8, where the flattened ends of the base supports 2 are inserted, which can, in case, be solidly constrained to the rod by means of rivets 9 or other fastener (FIG. 2).

For the assembly, the procedure is the following:

first the belts are cut in the right dimension and then the ends are folded up around the tongues 5, inserting afterwards the U shaped section 6, the arms of which, elastically tending to converge one towards the other, block the end of the belt against the tongue, keeping it in position.

The belt is then folded up around the U shaped element 6 and then around the section 3. The opposite end is constrained in the same way to the second rod or lateral support that builds the framework.

At this point the base supports 2 are mounted, inserting their ends into the bends 8 of the sections 3, in order to fix them definitively in position through rivets or similar fasteners.

The length of the belts is calculated in such a way that inserting the supports 2 between the sections or rods 3, these are slightly spaced, tending the belts in this way.

The belts exert then a traction that blocks with strength the U shaped elements 6 against the tongues 5, automatically blocking solidly the ends of the belts themselves.

In this way the fixing of the belts to the framework of the support is secured without necessity to use hooks, holes or other fastening devices.

It should be clear, from the provided description, that the plane according to the innovation, is, thanks to the peculiar configuration, much more convenient than those already known. First a smaller number of pieces, are necessary with a consequent reduction of costs and of assembly times. Additionally the assembly is simplified and faster.

Of course the dimensions, as well as the materials used, could vary according to the use requirements.

I claim:

1. A plane for a seat of an armchair, divan, chair or similar furniture, the plane comprising:

a pair of spaced apart lateral sections, each lateral section having a downwardly protruding tongue;

a pair of U shaped elements corresponding to the pair of downwardly protruding tongues, one U shaped element oriented around each protruding tongue;

a plurality of belts connected between the pair of spaced apart lateral sections, each belt having a pair of ends, one end of each belt passing around outside one of the U shaped elements, folded back and interposed between the same U shaped element and corresponding protruding tongue; the other end of each belt fastened in the same manner to the other U shaped element and other protruding tongue; and means for tensioning each of the plurality of belts, wherein the tension exerted by each belt is directed against each U shaped element such that each end of each belt is blocked against the corresponding protruding tongue, thereby constraining the belt in the framework.

2. A plane for a seat according to claim 1, wherein the means for tensioning comprises at least a pair of shaped tubular elements positioned between the spaced apart lateral sections, the pair of lateral sections, and receiving means for attaching the shaped tubular elements to each of the pair of lateral sections.

3. A plane for a seat according to claim 2, wherein the receiving means comprises one of a plurality of bends and a plurality of hollows located in the spaced apart lateral sections.

4. A plane for a seat according to claim 2, wherein each of the plurality of belts has an elastic strength, the means for tensioning further comprising the elastic strength exerted on each spaced apart lateral section such that the pair of spaced apart lateral sections are blocked against the at least one pair of tubular elements.

* * * * *